United States Patent [19]

List

[11] Patent Number: 4,938,152

[45] Date of Patent: Jul. 3, 1990

[54] FLEXIBLE RAILWAY CAR TRUCK

[75] Inventor: Harold A. List, Bethlehem, Pa.

[73] Assignee: Railway Engineering Associates, Inc., Bethlehem, Pa.

[21] Appl. No.: 285,285

[22] Filed: Dec. 15, 1988

Related U.S. Application Data

[60] Continuation of Ser. No. 897,776, Aug. 18, 1986, abandoned, which is a continuation-in-part of Ser. No. 583,650, May 17, 1984, abandoned, which is a division of Ser. No. 348,922, Feb. 16, 1982, Pat. No. 4,483,253, which is a continuation-in-part of Ser. No. 948,878, Oct. 5, 1978, Pat. No. 4,455,946, which is a continuation-in-part of Ser. No. 608,596, Aug. 28, 1975, Pat. No. 4,131,069.

[51] Int. Cl.[5] ..... B61F 3/00

[52] U.S. Cl. ..... 105/208; 105/224.1

[58] Field of Search ..... 105/182.1, 208, 208.2, 105/218.1, 222, 224.05, 224.1

[56] References Cited

U.S. PATENT DOCUMENTS

| | | | |
|---|---|---|---|
| 635,151 | 10/1899 | Scott | 105/208 X |
| 1,606,495 | 11/1926 | Barrows | 105/208 |
| 1,623,037 | 4/1927 | Anderson | 105/208 X |
| 1,629,475 | 5/1927 | Bush | 105/208.2 |
| 1,730,234 | 10/1929 | O'Connor | 105/224.1 |
| 1,747,871 | 2/1930 | Kiesel, Jr. | 105/208 X |
| 1,783,737 | 12/1930 | Martin | 105/208 X |
| 1,964,184 | 6/1934 | Shafer | 105/208 X |
| 2,207,848 | 7/1940 | Barrows | 105/224.1 |
| 2,273,201 | 2/1942 | Holland et al. | 105/224.05 X |
| 2,287,575 | 6/1942 | Sensenich | 105/224.1 |
| 2,453,915 | 11/1948 | Howard | 105/208 X |
| 2,635,557 | 4/1953 | Leese | 105/208.2 |
| 2,682,232 | 6/1954 | Wulff | 29/401.1 |
| 2,719,490 | 10/1955 | Barrett et al. | 105/208 X |
| 3,211,112 | 10/1965 | Baker | 105/224.1 |
| 3,276,395 | 10/1966 | Heintzel | 105/224.1 |
| 3,381,629 | 5/1968 | Jones | 105/218.1 |
| 3,638,582 | 2/1972 | Beebe | 105/222 X |
| 3,670,660 | 6/1972 | Weber et al. | 105/208 X |
| 4,030,424 | 6/1977 | Garner et al. | 105/182.1 |
| 4,131,069 | 12/1978 | List | 105/224.1 X |
| 4,236,457 | 12/1980 | Cope | 105/218.1 |
| 4,363,278 | 12/1982 | Mulcahy | 105/224.1 X |

*Primary Examiner*—Johnny D. Cherry
*Assistant Examiner*—Joseph D. Pape
*Attorney, Agent, or Firm*—Charles H. Lindrooth

[57] ABSTRACT

A multiple axle railway truck is disclosed having side frames and a plurality of axled wheelsets, with roller bearings mounted in pedestal jaws having clearance fore-and-aft of the vehicle, thereby providing freedom for relative yaw motions of the wheelsets, structure interconnecting the side frames including a transverse shear plate restraining relative fore-and-aft movement of the side frames and accommodating relative pitching movement of the side frames; flat resilient pads between the roller bearings and the base of the pedestal jaws for at least one wheelset; and a method for retrofitting existing trucks to embody the structure referred to.

5 Claims, 4 Drawing Sheets

FIG. 7
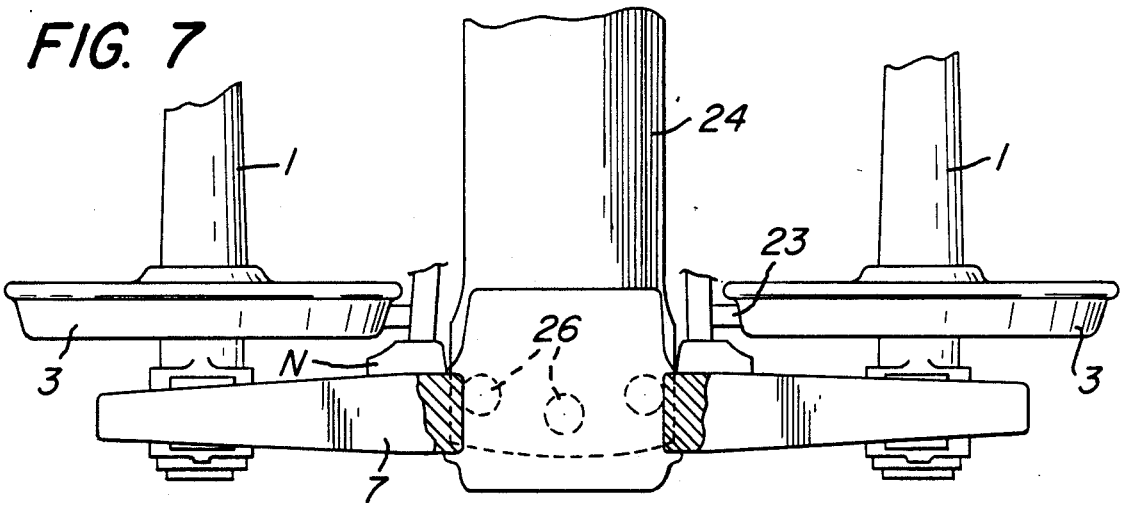
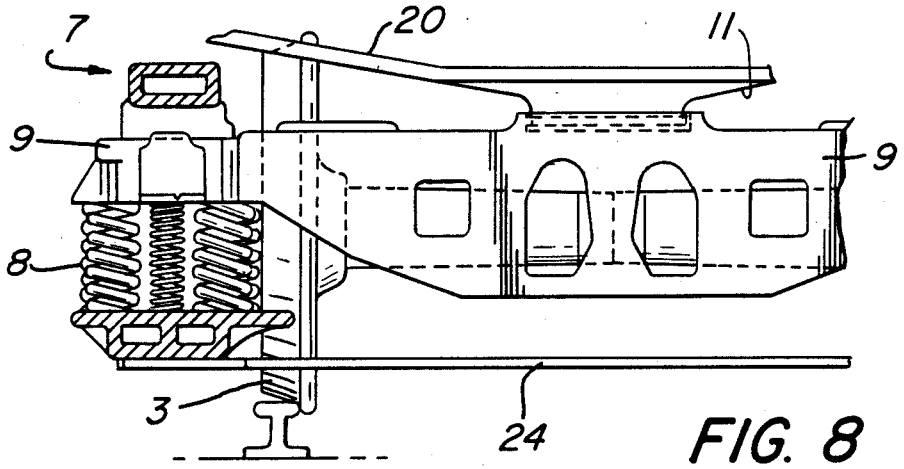
FIG. 8
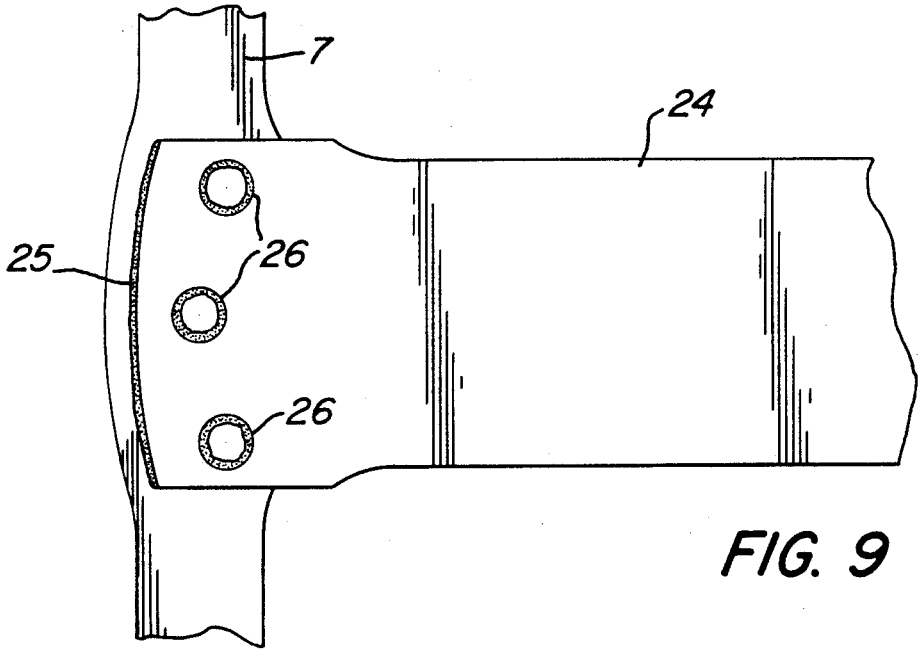
FIG. 9

FIG. 10
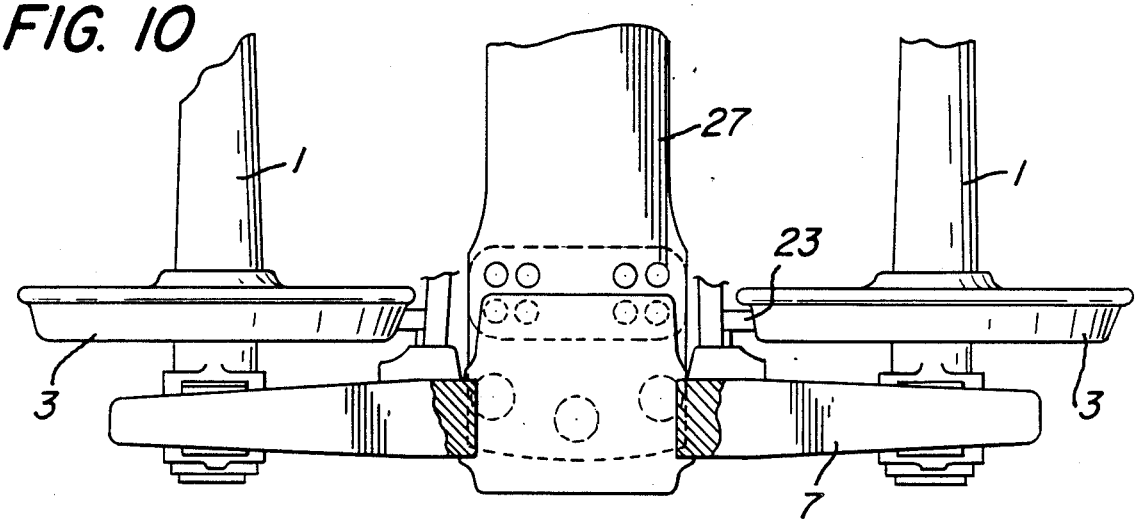
FIG. 11
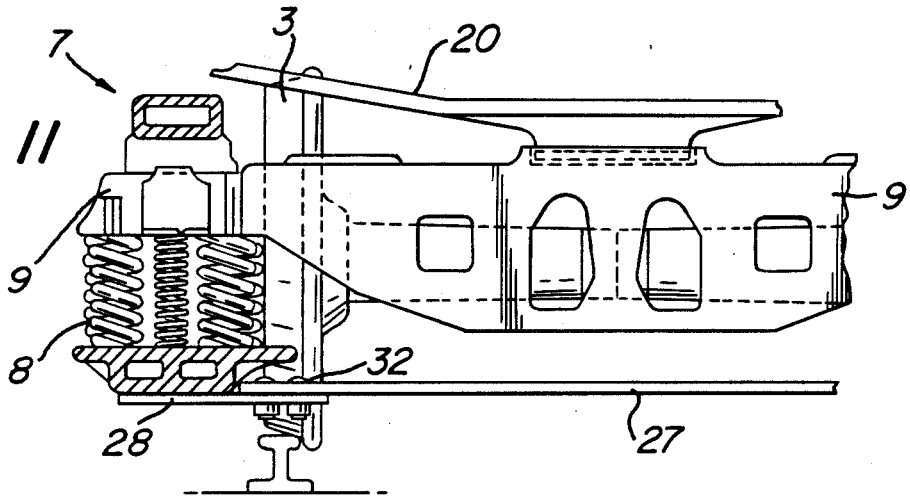
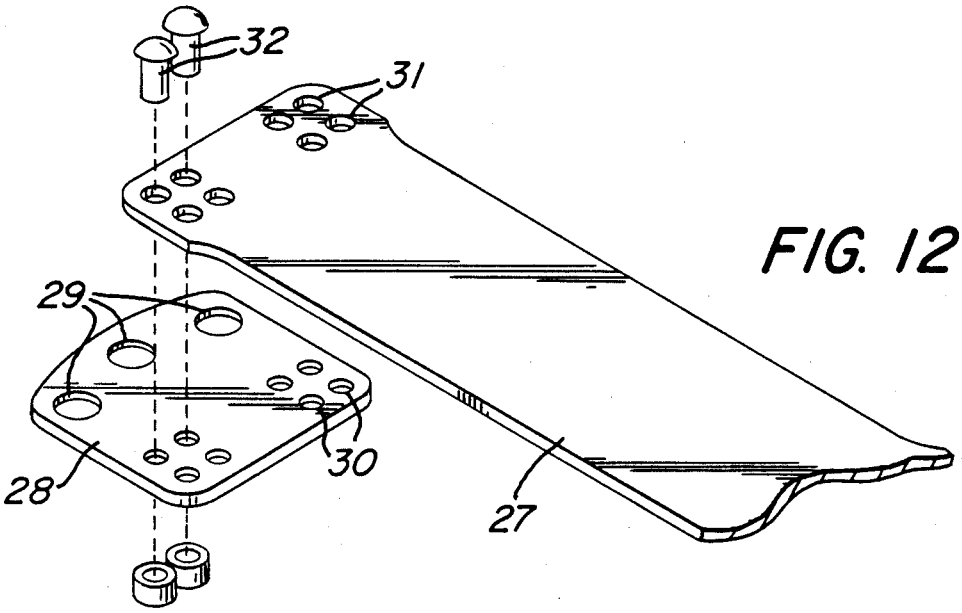
FIG. 12

FLEXIBLE RAILWAY CAR TRUCK

CROSS REFERENCES

This application is a continuation of prior application Ser. No. 897,776, now abandoned, filed on Oct. 18, 1986 which is a continuation-in-part of application Ser. No. 583,650, filed May 17, 1984, now abandoned, which is a division of application Ser. No. 348,922, filed Feb. 16, 1982, issued Nov. 20, 1984, as U.S. Pat. No. 4,483,253, which is a continuation-in-part of application Ser. No. 948,878, filed Oct. 5, 1978, and issued June 26, 1984, as U.S. Pat. No. 4,455,946, which in turn is a continuation-in-part of application Ser. No. 608,596, filed Aug. 28, 1975, and issued Dec. 26, 1978, as U.S. Pat. No. 4,131,069.

BACKGROUND OF THE INVENTION

The subject matter of the invention relates to railway trucks, especially a type of truck sometimes referred to as a bogie, i.e., an assembly comprising a basic three-piece frame structure including a bolster and a pair of side frames, with two wheelsets mounted by means of bearings to the side frames.

The invention is concerned with dramatically changing the inter-axle parameters of such railway trucks.

In each wheelset, the wheels are fixed on the axles. The truck frame and thus the truck as a whole is mounted for pivotal or swiveling motion with respect to the frame of the car with which the truck is associated, for which purpose, the bolster of the truck is connected with the body of the car by means of a central upright pivot.

In the past, railway cars have been provided with a wide variety of trucks. For many years, the wheelsets were mounted in the truck side frames by means of journal ("plain") bearings. However, in recent years, the journal bearings have been replaced by roller bearings, and the present day conventional truck is known as the AAR three-piece roller bearing freight car truck.

Prior to the introduction of roller bearings, it was common to incorporate spring planks, i.e., a generally long flat metal or wood plank extending transversely between the two side frame members and positioned so that the ends of the plank extend between the side frame members and the springs. Their position was usually maintained primarily by the weight of the car. Sometimes, interfitting means on the plank and the side frames were provided in order to keep the plank from working out of place in service.

In plain bearing trucks, such spring planks were found to have some utility in limiting parallelogramming of the side frames in curves and to position the side frames in the roll direction. However, such spring planks are not effective in preventing the small angle parallelogramming motions involved in truck hunting at high speeds on tangent track, and this has been found to be a serious disadvantage.

Spring planks have also been employed in certain passenger and transit car trucks in combination with a "swing hanger" support from a rigid truck frame to supply a "soft" lateral suspension. In this case, it is the rigid truck frame and the axle bearing/truck frame interface rather than the spring plank which is involved in determining whether the truck has a hunting problem.

The use of spring planks in freight car trucks was generally discontinued prior to the introduction of roller bearings for several reasons. For example, it was observed that the friction between the spring plank and the side frames contributed to the axle misalignment problem on tangent track by capturing the parallelogrammed position occurring in curves. This causes the wheels to run with an angle to the track centerline for long distances following curves. Moreover, because of the lack of isolation of the spring plank from wheel/rail impacts, breakage of the spring plank was common.

In plain, i.e., journal bearing trucks, the elimination of the spring plank did not result in a significant amount of truck hunting, although wheelset hunting was rather common. This usually occurred within the lateral clearance of the journal and did not result in any severe periodic lateral motion of the truck frame or of the car body. However, with the introduction of the roller bearing, truck hunting became a major problem. It was also observed that wheel flange wear was more severe with roller bearing trucks. At the time of adoption of the roller bearings, it was not fully appreciated that the plain or journal bearing had permitted a small amount of inter-axle steering.

There have been many unsuccessful attempts to solve the truck hunting problem which accompanied the introduction of roller bearings. One of these was to introduce resilient pads to simulate the lateral clearance previously present with plain bearings. Experiments were also made with spring planks alone. These were more promising, but they were not significantly effective, and they provided no relief for the wheel/rail wear problem because of the complete lack of any axle steering capability.

Through the use of analytical tools and techniques developed in recent years, we now understand the reasons why resilience was not a substitute for the bearing clearance and tended to make matters worse. We also now understand why the use of spring planks alone tended to introduce as many problems as it solved. Various of these reasons are brought out herebelow.

It is first noted that the AAR roller bearing truck currently in general use has several serious shortcomings which are as follows.

Firstly, the truck framing is subject to a parallelogramming motion in which there is yaw motion between the side frames and the bolster, and the side frames can move relatively to each other in the fore-and-aft direction. Secondly, the wheelsets are prevented from engaging in significant steering motions with respect to each other because of the large friction forces which are present between the roller bearing adapters and the side frames. Thirdly, because of the crude or inaccurate assembly tolerances commonly present in conventional trucks, and because of the action of the brake shoe forces, there is likely to be a small axle-to-axle angle present at all times.

Because of the parallelogramming motion, truck hunting is widespread, especially with lightly loaded cars. Truck hunting causes excessive wear of many truck and car body components, and it will cause significant damage to certain types of lading. Furthermore, these trucks tend to retain the parallelogrammed position after leaving a curve, and both axles tend to run with a substantial wheel/rail angle of attack for long distances on tangent track, even if the assembly tolerances are good.

The prevention of the steering of one axle relative to another within the truck makes it impossible for the leading axle to attain a radial position in curves, and this is a serious disadvantage. It also prevents the axles from steering away from assembly errors to a parallel position on tangent track.

All of the above shortcomings of the three-piece roller bearing trucks are effectively remedied by the constructions described in my prior patents No. 4,131,069 and No. 4,455,946, above identified. The effectiveness of the arrangements of those prior patents has been established by extensive field testing showing that the flange wear rate is characteristically reduced to one-third of the wear rate in conventional trucks. Moreover, reductions in the average rolling resistance in travel of the vehicle have also been found to be as large as 30 percent. The basic theoretical approach to choosing the amount of parallelogramming restraint and steering flexibility applied to the inter-axle motions of trucks embodying the inventions of the two patents just identified is summarized in a technical paper by Marcotte, Caldwell and the present applicant, which was presented to the Winter Annual Meeting of the American Society of Mechanical Engineers in 1978. This paper defines two key parameters, the "Stiffness Ratio, R" and the "Normalized Yaw Stiffness", and describes how these parameters affect truck stability and curving. A value for "R", the ratio of the inter-axle steering (Normalized Yaw) stiffness to the parallelogramming stiffness, between 0.5 and 1.0 has been found to give the best combination of stability and curving. A low value for the Normalized Yaw stiffness is needed for good curving. With the steering arm constructions of the '069 and '946 patents, it is relatively easy to provide the desirable low value for both of these parameters. Without steering arms, only less desirable values for "R" greater than 1.0 are available.

The type of analysis outlined by the paper above referred to also sheds considerable light on the shortcomings of the conventional AAR truck and the lack of success of the earlier efforts to correct those shortcomings. For example, the conventional AAR truck has an "R" value of about 10, which is very poor. Adding resilient pads alone to conventional roller bearing trucks increases the value for "R", making truck hunting worse. Adding a spring plank alone will reduce "R" and reduce truck hunting, and it will prevent parallelogramming of the truck frame and limit the wheel/rail angle of attack on tangent track, but without resilient pads, the lack of axle steering makes curving very poor and makes the tangent track performance less desirable than it could be.

SUMMARY OF THE INVENTION

The present invention provides a substantial improvement to the inter-axle parameters of a conventional roller bearing freight car truck at low cost. The improvement to high-speed stability is comparable to that obtained with the arrangement of the '069 and '946 patents. The improvement to curving is not as great as in said prior patents, but in certain applications where stability is very important because speeds are high, and improved curving is less important because axle loads are relatively light, the cost savings of the present invention relative to the "full steering" constructions of '069 and '946 are very attractive.

In general, improvement in inter-axle parameters is accomplished according to the present invention by employing a side frame interconnecting structure arranged to interconnect the side frames in a manner to rigidly preclude relative fore-and-aft movements of the side frames of the truck, while concurrently providing substantial freedom for relative pitching motions of the side frames about an axis extended transversely of the truck. At the same time, the invention further employs resilient pads introduced between the roller bearing adapters and the roof of the pedestal jaws of the side frames. Because of the presence of the side frame interconnecting structure, the addition of the resilient pads provides for improved self-steering of the axled wheelsets on curved track without exaggerating truck hunting at high speeds on tangent or straight track.

In one preferred embodiment, the side frame interconnecting structure comprises a transversely extending shear plate, such as a spring plank, but with its ends rigidly connected with the side frames, instead of the arrangement used with the conventional journal bearing trucks, where the ends of the spring plank merely lie between the side frame members and the springs of the truck, without rigid attachment. The spring plank employed desirably has torsional flexibility so as to accommodate relative pitching movement of the side frames without overstressing of the shear plate. Concurrently, with the use of the shear plate rigidly connected with the side frames, resilient pads are used between the roller bearings and the truck frame, providing a value for "R" which is only slightly above 1.0. In addition, an intermediate value for the normalized yaw stiffness is provided, thereby affording a substantial portion of the benefits of the '069 and '946 patent arrangements, but at a much smaller overall cost.

One preferred embodiment according to the present invention is disclosed in my patent 4,483,253 of which the present application is a continuation-in-part. The present application discloses the arrangement of said patent 4,483,253 and also other preferred embodiments, including the formation of the side frame interconnecting structure in the form of a transverse shear plate having separate terminal portions permanently secured to the side frames and a separable central portion, thereby permitting connection and disconnection for convenience in assembly and repair.

The present invention further provides for adaptation or retrofitting of existing conventional AAR three-piece journal bearing trucks with the frame interconnecting structure and the resilient pads.

In connection with the embodiments disclosed herein, it is particularly to be noted that all of the embodiments include not only the resilient pads between the roller bearings and the top of the pedestal jaws, but further include the side frame interconnecting mechanism, such as a shear plate, arranged to effectively restrain relative fore-and-aft movement of the side frames of the truck, while permitting freedom for relative pitching movements of the two truck side frames. In this way, parallelogramming of the side frames is effectively eliminated, which is of vital importance in reducing truck hunting, particularly at high speeds on tangent track.

Addition of resilient pads, without adding the mechanism for restraining parallelogramming of the side frames, would be highly undesirable because the employment of the resilient pads alone results in a high value for R and a consequent aggravation of the parallelogramming motions which are characteristic of high-speed truck hunting.

In connection with the provision for the self-steering function of the wheelsets, it will be understood that clearance between the roller bearing adapters and the pedestal jaws in the truck frames is needed. In most conventional AAR three-piece roller bearing trucks, the clearances provided in normal manufacture of the parts is ordinarily sufficient to provide for significant steering motions of the wheelsets However, in cases where the conventional AAR truck does not have the required clearances for the self-steering action, it is contemplated according to the invention to provide additional clearance between the bearing adapters and the pedestal jaws by appropriate machining. Since, according to the present invention, the necessary motions are not extensive, the necessary clearance or space in the pedestal jaws at each bearing adapter need only comprise a maximum of the order of ¼ to ⅛ inch in order to accommodate the desired self-steering action.

BRIEF DESCRIPTION OF THE DRAWINGS

FIGS. 7 to 9 illustrate retrofitting according to a second embodiment; and FIGS. 10 to 12 illustrate retrofitting according to a third embodiment.

PRIOR ART

Figure 1:
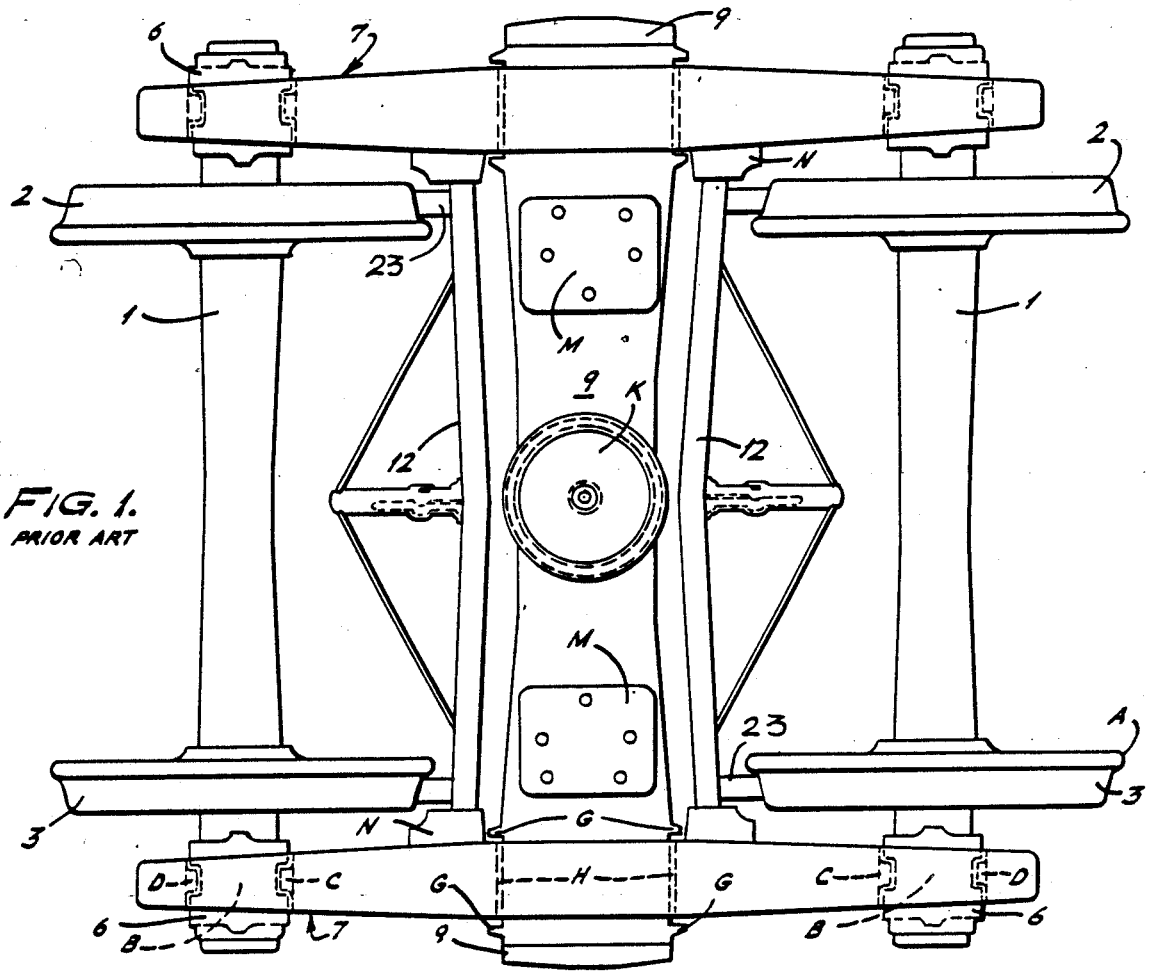
FIG. 1. PRIOR ART
FIGS. 1 to 3 are views illustrating a known truck prior to retrofitting according to the present invention.
Figure 2:
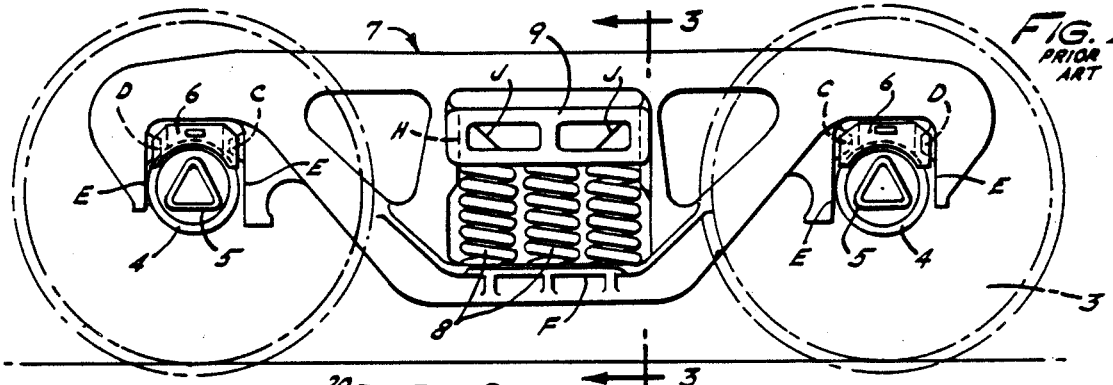
FIG. 2. PRIOR ART

FIG. 1 is a plan view of a typical, conventional, AAR roller bearing three-piece freight car truck, shown prior to the retrofitting contemplated in accordance with the present invention;

FIG. 2 is an elevational view of the same truck; and

Figure 3:
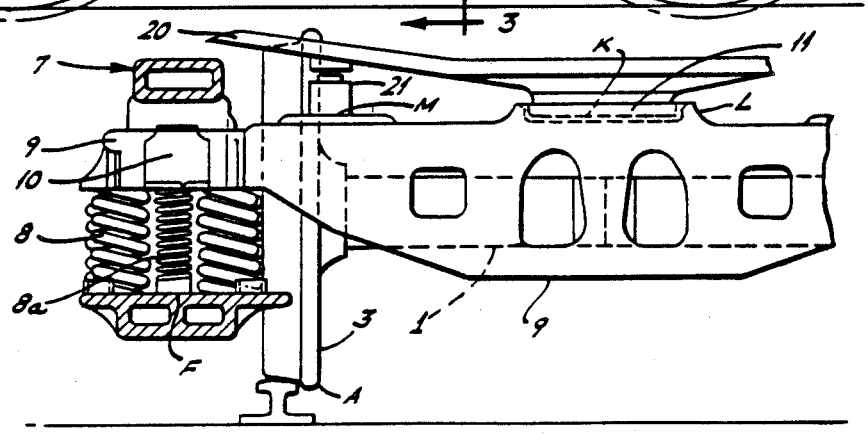
FIG. 3. PRIOR ART

FIG. 3 is a section through the spring group taken on line 3—3 of FIG. 2.

FIRST EMBODIMENT

Figure 4:
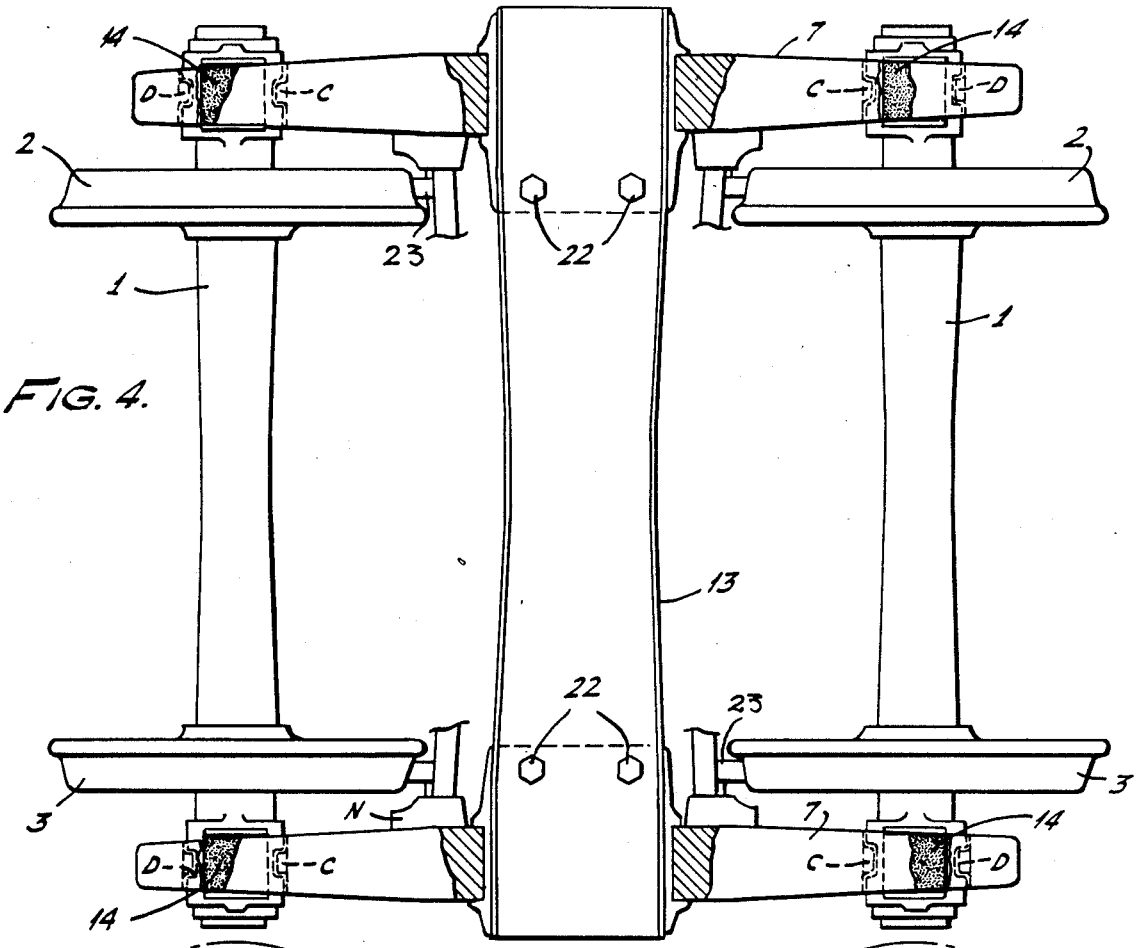
FIGS. 4 to 6 illustrate retrofitting of the truck of FIGS. 1 to 3 according to one embodiment of the invention.
Figure 5:
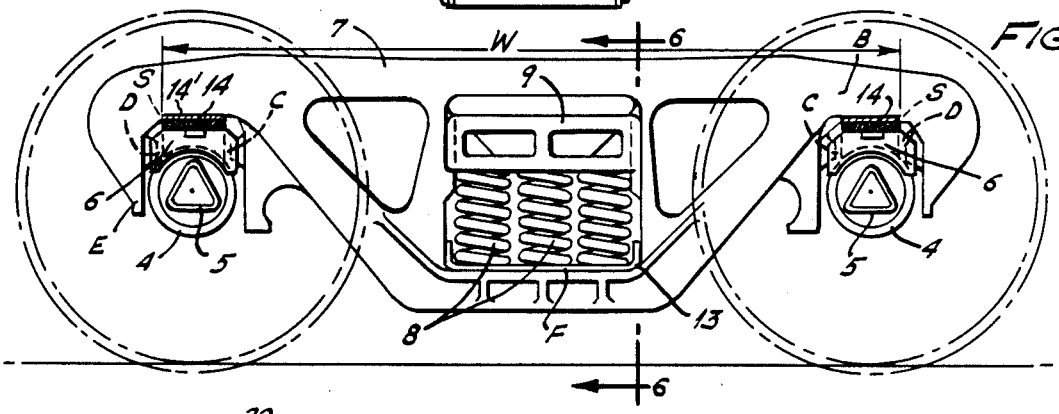
Figure 6:
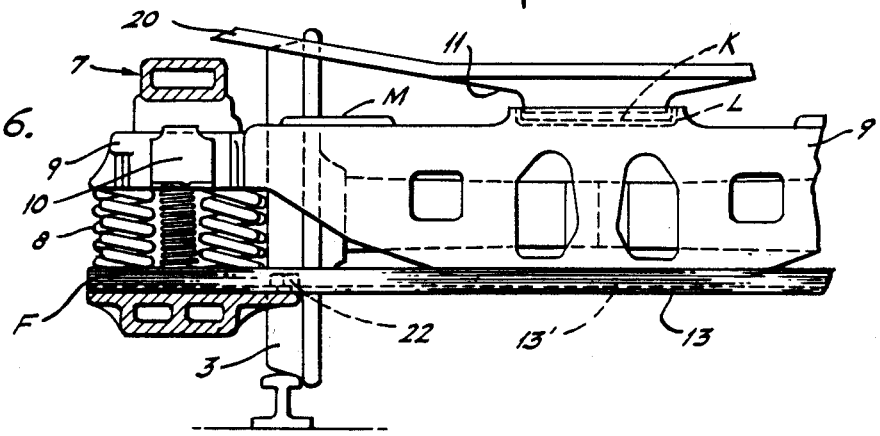

FIG. 4 is a plan view of the truck of FIG. 1 to which a spring plank or shear plate, and resilient side frame/-bearing adapter pads have been added, thereby bringing the truck into accordance with this invention;

FIG. 5 is an elevation of the truck in FIG. 4 and shows the open channel shape of the spring plank used in this embodiment; and FIG. 6 is a sectional view of the truck, the view being taken along the line 6—6 of FIG. 5.

SECOND EMBODIMENT

FIG. 7 is a fragmentary plan view of a portion of a retrofitted truck according to a second embodiment;

FIG. 8 is a fragmentary transverse section of the truck of the second embodiment; and FIG. 9 is a fragmentary bottom plan view of a portion of the truck frame and shear plate according to the second embodiment.

THIRD EMBODIMENT

FIG. 10 is a fragmentary plan view of a portion of a retrofitted truck according to a third embodiment;

FIG. 11 is a view similar to FIG. 8 but illustrating the third embodiment; and FIG. 12 is a fragmentary perspective view of portions of the components used in the third embodiment.

DESCRIPTION OF THE PRIOR ART

The conventional AAR roller bearing three-piece freight car truck shown in FIGS. 1–3 has two rotating axles 1 with pressed-on wheels 2 and 3 having conventional tread profiles which provide a larger than average rolling radius when the wheel/rail contact is near the flange A and a smaller than average rolling radius as the contact point moves away from the flange. Such a wheelset, when displaced laterally on the track, will tend to steer toward the track centerline under the influence of the difference in the rolling radii of wheel 2 compared with wheel 3.

Roller bearings 4 are pressed on the axles and retained by end caps 5. Vertical, longitudinal, and lateral loads are applied to the bearings through adapters 6. Vertical load is applied to each adapter by the side frame 7 at locations B (FIG. 1). Longitudinal and lateral loads are applied through frictional contact between adapters and side frames at locations B, with backup by contact at the interlocking side frames and adapters, which are shaped as shown at C and D. Longitudinal loads may also be exchanged directly between the bearings 4 and the side frames 7, at locations E.

The springs 8 are supported by the side frames in the regions F. The springs apply vertical, lateral and yaw forces to the side frames through the spring-carried bolster 9, which receives the vertical, lateral and yaw forces. Longitudinal loads are exchanged directly between the bolster and the side frames in the regions H. There is also some vertical, lateral and yaw force exchanged between the bolster and the side frames through the wedges 10 (FIG. 3) mounted in bolster pockets J and bearing on the side frame in the region H. Large lateral and yaw loads are exchanged by contact of the side frame with the bolster lugs shown at G (FIG. 1).

Under most conditions, the vertical load of the car body 20 is applied to the bolster 9, at K, through a center plate 11 formed on the car body. Lateral and longitudinal loads are applied to the bolster initially by friction at K (FIGS. 1 and 3) and then by contact of the car is circular to accommodate truck swivel. Friction between the center plate and the bolster at K tends to restrain truck swivel, and also smaller yaw motions of the bolster and the axles on straight track. Roll motion of the car body is controlled to a limited extent by the relatively large diameter of the contact surface K. However, it is usual and desirable to mount side bearings 21 on the bolster at M to prevent large roll motion of the car body relative to the bolster.

FIG. 1 shows conventional brake beams 12 mounted to the side frames in slots N. However, other known brake equipment, such as brake beams incorporating brake cylinders, can be used. Looking at FIG. 1, it can be visualized that when one axle moves laterally with respect to the other and the side frames move out of square, the brake beam can be driven laterally into the slot N. Therefore, clearance must be provided for this motion. This means that the brake beams can not be precisely guided laterally with respect to the wheelsets. As a result, the brake shoes can be displaced laterally on the wheel treads, causing flange wear on one wheel and hollow tread wear on the other. This tends to cause additional wheel wear by destroying the wheel diameter match. As shown below, the apparatus of the present invention substantially overcomes these difficulties.

FIRST EMBODIMENT OF THE INVENTION AS ILLUSTRATED IN THE FIGS. 4 TO 6

The primary feature of the present invention is the provision of a novel and very simple technique for retrofitting existing tracks to provide for steering of the wheel-sets. The invention may readily be applied to any present roller bearing, freight truck of the Association of American Railroads design, of the kind mentioned above and shown in the drawings. The invention teaches retrofitting of the AAR truck by the provision of a transverse plank in the truck, combined with the use of resilient means disposed to react between the axles and the side frames. Desirably, this means comprises elastomeric pads reacting between the axle bearing adapters and the pedestal areas of the side frames. Such pads, when stressed in shear, allow steering motions of the axles and develop a restoring force which tends to return the axles toward parallelism.

The retrofitting method is briefly described as follows.

An existing truck is selected having load-carrying side frames spanning two rotatable, roller bearing, axled wheelsets. The side frames are of the kind presenting laterally opposed pairs of pedestal areas or jaws within which are received the bearing adapters of the axle roller bearings, with the adapters in load-bearing relation with the pedestal areas of the side frames. The truck is further of the type which has a transverse bolster supported by the side frames through conventional springs and damping devices.

In accordance with the retrofitting technique of FIGS. 4 to 6, a transverse plank is installed directly beneath and in parallelism with the bolster and spaced therefrom. The ends of the plank are rigidly connected with the truck frames in the manner described more fully herebelow; and the ends of the plank may be interposed between the truck springs and the side frames. The plank inserted comprises a structural beam or plank of shape and proportions selected to restrain relative fore-and-aft motion between the two side frames, as viewed in plan, without preventing relative pitching motions of the side frames in vertical planes.

The method also includes introduction of yieldable motion restraining means, for example, elastomeric pads, between the roller bearing adapters and the side frames, preferably at both ends of both wheelsets.

Now with detailed reference to FIGS. 4, 5 and 6 of the drawings, it should be noted that these figures show the same basic structure as illustrated in FIGS. 1 to 3. To simplify the presentation, parts of the structure shown in FIGS. 4 to 6, which are similar to parts appearing in FIGS. 1 to 3, are identified with similar reference characters.

The plank inserted in the truck is shown at 13, and its channel shape will be understood by comparison of FIGS. 4, 5 and 6. When rigidly secured in position as described hereinafter, the plank 13 restrains the side frames 7 from moving relative to one another in plan view. It is important that the plank 13 remains out of contact with the overlying bolster 9. A gap is shown at 13' in FIG. 6 and should be of such dimension as to be maintained, even when the car is loaded. The plank has torsional flexibility such as to permit relative pitching motion of one side frame relative to the other. To maximize this flexibility, the plank desirably has an open channel-shaped cross section, as shown in FIG. 5. The stresses associated with the twist can be reduced, if desired, by providing cutouts (not shown) in the broad flat bottom portion between the side frames.

As described hereinafter, the plank or shear plate, such as shown at 13 in FIGS. 4, 5 and 6, may be rigidly secured in position in several different ways.

With the two side frames 7 rigidly interconnected by the plank to prevent relative motions in plan view, the shear stiffness of the elastomeric pads 14, added between the adapters 6 and the side frames, at pedestal locations B, is effective in restraining inter-axle lateral and yaw motions, and thereby prevents objectionable oscillations. It should be understood that, of the two shear forces in the pads, i.e., longitudinal and lateral, the longitudinal forces are the more important for stability, and that the plank, by restraining the side frames longitudinally, assures that the longitudinal restraining forces in the pads will be fully effective. It is possible to shape the material in these pads to optimize the stiffness ratio "R" and the overall "Yaw" stiffness, as will be known from my prior disclosures. For many applications, a flat pad will suffice. If a flat pad is chosen, as shown, it should be kept in mind that the roller bearing adapter will be restrained from roll motion by the axle, but it will be possible for the adapter to pitch relative to the side frame and axle, making the effective longitudinal stiffness lower than the lateral In general, for freight car truck applications, this is acceptable.

While the bolster 9 has been omitted from FIG. 4, in the interest of clarity of illustration, its position above and in spaced parallelism with the plank 13 is clear from FIGS. 5 and 6. The axles 1, wheels 2 and 3, bearings 4, caps 5, adapters 6, side frames 7 and springs 8, are all similar to the same elements shown in FIGS. 1 to 3, and are characteristic of the truck selected for retrofitting.

If the invention is applied to an existing car, the coupler height will be raised by the thickness of the plank inserted and the thickness of the pads. Couplers are not shown, but it should be understood that the increase in coupler height can be kept to about one-half the pad thickness by using pads under only one end of each side frame, preferably the end nearest the coupler, as taught by the '069 patent. In some cases, the increase in coupler height can be compensated for by removing shims which are frequently provided to offset the loss in free spring height that normally occurs in service.

The resilient pads 14 may take a variety of forms, but preferably those pads are formed and adhesively associated with metal plates on the upper side, as indicated at 14' in FIG. 5. Pockets having edge stops S at the outer sides may also be provided by machining existing truck frames, or may be cast into the side frames in region B when the invention is used on new cars. For convenience in manufacture and the interfitting of the parts, it is contemplated to employ a configuration having stops S only at the outer sides of the pockets formed to accommodate the metal plates 14'. Since in conventional AAR roller bearing, three-piece trucks, the brakes (as indicated at 23 in FIG. 4) are located between the axled wheelsets, the application of the brakes will tend to separate the pads in the pockets to the limit represented by the line W as applied to FIG. 5.

Preferably also the pads 14 are formed with a projection adapted to interengage with a socket provided on the upper surface of the associated bearing adapter 6. With this configuration for the pads and the associated portions of the side frames and bearing adapters, the relation adapters provides the most favorable interrelationship between these parts for minimizing hunting when the truck is travelling on straight track.

In adopting the features of the invention to an existing truck, the clearances at locations C, D and E should be checked, and, if needed, the longitudinal clearance should be increased to provide a minimum of ⅛ inch at locations C, D and E. This will assist in increasing the curving range. The lateral clearance at locations C and D should also be at least ⅛ inch at both locations. In making such modifications, it is preferable to have the clearance at D slightly larger than at C. Having the backup for lateral forces in the pads 14 occur at D, rather than C, will aid the dynamic recovery of the truck from major lateral track deviations.

As shown in FIGS. 4, 5 and 6, the shear plate or plank 13 is rigidly secured to the side frames by bolts indicated at 22.

Because the inserted plank prevents large lateral motion of one axle relative to the other, the brake shoes diagrammatically indicated at 23 can be guided laterally in more precise fashion, relative to the wheel treads, by using centering springs (not shown) in the pockets N (FIG. 4). Any conventional brake equipment can be accommodated.

The plank shown in FIGS. 4 to 6 is inserted in the manner of a spring plank, i.e., with its ends extending under the truck springs. However, the plank need not necessarily be inserted in this manner. It may be terminated short of the springs and fastened to the side frames in some other manner, as by bolting to some lower portions of the side frames. Even where the plank ends extend under the springs, as in FIGS. 4 to 6, it is also contemplated to provide a fastening means for securing the ends of the plank to the side frames. This will assure avoidance of relative yaw motions, for instance, in high-speed operation of a lightly loaded truck. Such a fastening means may take a variety of forms, for instance, bolts 22 as described above.

When the arrangement of the invention is to be incorporated in newly manufactured trucks, attachment lugs for the transverse plank may be provided on the side frames, and the ends of the plank would not necessarily be positioned under the springs, such alternative forms being included in the alternative embodiments shown in FIGS. 7 to 9 and FIGS. 10 to 12.

Similarly, in newly manufactured trucks, the side frame dimensions can be adjusted to accommodate the thickness of the pads and the spring planks without increasing the coupler height when new springs are used.

SECOND EMBODIMENT OF THE INVENTION AS ILLUSTRATED IN FIGS. 7 TO 9

As described above, the first embodiment shown in FIGS. 4 to 6 includes the use of the resilient means between the bearing adapters and the roof of the pedestals, in combination with shear plate or plank means with its end portions arranged to lie between the springs and the side frame members of the truck, in the manner of a spring plank, this shear plate or plank being rigidly fastened to the side frames, for instance by bolts indicated at 22 in FIGS. 4 and 6.

In the embodiment of FIGS. 7 to 9, it is contemplated that the same resilient means be utilized as described above in relation to FIGS. 4 to 6, but instead of employing a shear plate extended between the springs and the side frames, shear plate or plank means are employed having end portions projecting under the lower edges of the side frame members. This shear plate is indicated at 24 in FIGS. 7, 8 and 9, and it will be seen that the end edges of the plate are welded to the underside of the side frame members, as indicated at 25 in FIG. 9. This weld 25 constitutes an end weld strip or seam. In addition, it is preferred to provide localized areas of welding by providing at least several apertures through the end portions of the plate 24, and further to provide the additional weld joints 26 located at the periphery of the apertures, in the manner clearly apparent from FIG. 9. This provides a joint integrally uniting the shear plate and the side frame members.

The provision of weld joints 25 and 26 between the shear plate and the side frame members is of advantage in assuring permanence of the interconnection of these parts, but it will be understood that for at least some purposes, if desired, the ends of the shear plate may be rigidly fixed to some portions of the side frames by means of bolts, preferably provided with means adapted to resist bolt separation under the influence of vibration.

With the shear plate 24 of appreciable width, for instance about 16 inches, and of a thickness of the order of ¼ inch, the shear plate effectively serves to prevent relative fore-and-aft movement of the side frames of the truck, while permitting vertical motions of the side frames, especially relative vertical pitching motions, which is desirable in order to accommodate irregularities in the height of the rails.

THIRD EMBODIMENT OF THE INVENTION AS ILLUSTRATED IN FIGS. 10 TO 12

The third embodiment, as in the first and second embodiments contemplates employment of the resilient means between the bearing adapters and the roof of the pedestal jaws, together with a modified form of shear plate interconnecting the side frame members.

In the embodiment of FIGS. 10 to 12, terminal portions of the shear plate are formed separately from the central portion, the central portion being indicated by the reference numeral 27 and the terminal portions by the numeral 28. The terminal portions 28 may be fastened to the side frames by vibration resistant forms of bolts, but preferably, the terminal portions 28 are integrally united with the side frame members in the same general manner as the ends of the shear plate 24 in the embodiment of FIGS. 7 to 9. For this purpose, the terminal portions or brackets are provided with apertures 29 to provide spaced zones of welding, as with the welded joints 26 shown in FIG. 9. Welding of the outer edge and the side edges of the terminal portions to the side frames is desirable in order to integrally unite the plates with the truck frames.

The inner edge portions of the terminal portions 28 and also the end portions of the central plate 27 are further provided with apertures 30 and 31 arranged to register with each other when the structure is assembled in order to accommodate a riveting type of interconnection including elements such as indicated at 32. While it is possible to employ nuts and bolts of standard helical screw configuration, it is preferred not to employ components of that type, but rather to employ components, some of which are known in the trade as "Huck" bolts. This type of connecting device is made of inner and outer elements, with circular (rather than helical) threads or ridges which, in assembly, are forced together under pressure and which are not subject to separation under the action of vibration in the manner frequently encountered with helically threaded nuts and bolts.

As in the second embodiment, it is contemplated that the shear plate be of appreciable width, for instance about 16 inches and further that the central part of this plate should have a thickness of the order of about ½ inch.

SUMMARY

From the foregoing, it will be seen that all embodiments of the invention provide for the concurrent use of the side frame interconnecting means and the resilient means between the bearing adapters and the roof of the pedestal jaws. In preferred embodiments, such resilient means are desirably provided at each end of each of the two axles of the truck, although at least some resilient restraint of the angular motion of the axles in a horizontal plane will result from the employment of the resilient means with only one of the two axles.

In all embodiments, such resilient means are, in any event, used in combination with a mechanism acting to restrain relative fore-and-aft movement of the side frames at the two sides of the truck, while, at the same time, accommodating relative pitching movement of the side frames in vertical planes. The means provided for restraining the relative fore-and-aft movement while permitting relative pitching movement of the side frames may take a variety of forms and need not necessarily take the form of a shear plate.

Where a shear plate is used and mounted in the manner of the third embodiment, it is to be noted that the terminal portions 28 are integrally united with the side frame members, whereas the central portion 27 may be separately formed and handled. The integral uniting of the terminal or bracket portions with the side frame members may also be accomplished in other ways, as by integrally casting such bracket portions with the side frame members, or by mechanically attaching the brackets to the side frames, in which event some of the welded joints above referred to would not be needed.

It is of importance in all of the embodiments that the connection of the frame interconnecting means, such as a shear plate, with the side frames provides a rigid interconnection joint or joints positively restraining relative fore-and-aft movements of the two side frames while, at the same time, permitting relative pitching movement of the side frames with respect to each other, this pitching motion being provided for by virtue of the torsional flexibility of the frame interconnection, such as the shear plate. With this side frame interconnection, it becomes practical to use the resilient pads for enhancement of selfsteering on curves, thereby providing an economical system for concurrently achieving both freedom from high speed hunting on straight track and self-steering on curves.

It is to be kept in mind that the invention contemplates retrofitting existing trucks and also contemplates construction of new trucks embodying the structural features of the invention.

I claim:

1. A method for retrofitting a railroad vehicle truck with mechanism providing for wheelset steering, comprising the following steps:

a) selecting an existing truck having two load-carrying side frames each having means defining two spaced pairs of pedestal jaws each having a base between the jaws, the pedestal jaws of the two side frames being arranged in opposed pairs, transversely of the truck, two wheelsets each fixed on an axle extended transversely of the truck in a horizontal plane, outboard portions of each axle each having roller bearing means each including a bearing adapter, each bearing adapter of each axle being in load-receiving relation with the base of a corresponding one of said pairs of pedestal jaws, and a bolster extended transversely of the truck and having opposed end portions each supported by one of said frames through the agency of truck springs carried by that side frame, the bolster having a central vehicle load bearing region inboard of said frames and a pivot for mounting the truck on the vehicle with freedom for truck swiveling motion;

b) interconnecting the side frames of the selected truck by securing opposite end portions of a transverse interconnecting structure to the side frames at points spaced from each other fore-and-aft of the side frames to thereby restrain relative fore-and-aft motions of the side frames, the interconnecting structure being torsionally flexible to provide freedom for relative pitching motions of the side frames; and c) introducing resilient shear means in load-transmitting position between the bearing adapters and the base of the pedestal jaws for at least one of the wheelsets in order to provide resilient restraint of relative axle steering motions.

2. A method in accordance with claim 1, in which the transverse interconnecting structure comprises a transverse plank, installing the transverse plank to underlie the bolster, in spaced relation therebeneath, and providing the transverse plank with a pair of spaced elongate flanges, the installation being such that each of said flanges extends closely along a corresponding side of the bolster.

3. A method for retrofitting a railroad vehicle truck with mechanism providing for wheelset steering, comprising the following steps:

a) selecting an existing truck having two load-carrying side frames each having means defining two spaced pairs of pedestal jaws each having a base between the jaws, the pedestal jaws of the two side frames being arranged in opposed pairs, transversely of the truck, two wheelsets each fixed on an axle extended transversely of the truck in a horizontal plane, outboard portions of each axle each having roller bearing means each including a bearing adapter, each bearing adapter of each axle being in load-receiving relation with the base of a corresponding one of said pairs of pedestal jaws, and a load bearing bolster extended transversely of the truck and having vehicle support means inboard of the said side frames and opposed end portions each supported by one of said frames through the agency of truck springs carried by that side frame, the bolster further having a pivot for mounting the truck on the vehicle with freedom for truck swiveling motion;

b) interconnecting the side frames of the selected truck by securing opposite end portions of a transverse interconnecting structure to the side frames at points spaced from each other fore-and-aft of the side frames to thereby restrain relative fore-and-aft motions of the side frames, the interconnecting structure being torsionally flexible to provide freedom for relative pitching motions of the side frames;

c) increasing the clearance between the jaws of each pair of pedestal jaws in a direction fore-and-aft of the truck to assure freedom for movement of the bearing adapters fore-and-aft of the truck and thereby assure freedom for relative wheelset steering motions with respect to the truck side frames; and d) introducing resilient shear means in load-transmitting position between the bearing adapters and the base of the pedestal jaws for at least one of the wheelsets in order to provide resilient restraint of relative axle steering motions.

4. A method for retrofitting a railroad truck having a pair of wheelsets with mechanism providing freedom for relative wheelset steering motions, comprising the following steps:

a) selecting an existing truck having two load-carrying side frames each having means defining two spaced pairs of pedestal jaws each having a base, the pedestal jaws of the two side frames being arranged in opposed pairs, transversely of the truck, two wheelsets each fixed on an axle extended transversely of the truck in a horizontal plane, outboard portions of each axle each having roller bearing means each including a bearing adapter, each bearing adapter of each axle being in load-receiving relation with the base of a corresponding one of said pairs of pedestal jaws, the pedestal jaws having clearance providing for motions of the roller bearing adapters in relation to the side frames in the longitudinal direction, and a bolster extended transversely of the truck and having opposed end portions each supported by one of said frames through the agency of truck springs carried by that side frame, the bolster having a pivot for mounting the truck on the vehicle with freedom for truck swiveling motion;

b) installing a torsionally flexible transverse plank generally parallel to and spaced from the bolster, the plank lying in a horizontal plane and having end portions rigidly connected with said side frames, thereby restraining relative motions of the side frames in a direction fore-and-aft of the truck while providing freedom for relative angular movement of the truck frames in vertical planes; and c) introducing resilient means in load-transmitting position between the bearing adapters and the base of the pedestal jaws for at least one of the wheelsets in order to resiliently restrain longitudinal motions of the bearing adapters and thereby resiliently restrain relative axle steering motions.

5. A vehicle truck assembly, comprising: axled wheelsets, main truck framing including load-carrying bolster extending transversely of the truck, said bolster having centrally located vehicle support means and a pair of side frame members each having springs associated with a corresponding end portion of said bolster, said vehicle support means being inboard of said side frame members, said spring transmitting load from the load-carrying bolster to the associated side frame member, and each side frame member having means defining a pair of pedestals for load-imposing cooperation with spaced axle portions of axled wheelsets, roller bearings for each of said spaced axle portions, each such roller bearing having an adapter in load-carrying association with a corresponding pedestal, structure interconnecting the side frames of the truck and including a transversely extending frame interconnecting plank extending in a generally horizontal plane between the side frame members of the truck for restraining relative fore-and-aft movement of the side frame members, the frame interconnecting plank being torsionally flexible and thereby accommodate relative pitching movement of the side frame members in vertical planes, each pedestal for at least one of the wheelsets having a pair of spaced pedestal jaws embracing the associated roller bearing and its adapter, the pedestal jaws of each pair being spaced from each other to provide a pedestal jaw space of greater dimension longitudinally of the truck than the corresponding dimension of the bearing and bearing adapter, and said pedestal jaw space being sufficient to provide clearance of at least ⅛ inch with respect to the associated bearing and bearing adapter in directions both fore and aft of the truck, and said clearance being unobstructed and thereby provide freedom for unimpeded yawing motions of the associated axled wheelset with respect to the side frames of the truck throughout the range of motion provided by said clearance, and a flat resilient shear pad lying in a horizontal plane in each pedestal jaw space for the bearing adapters for at least one of the axled wheelsets, each resilient pad being interposed between the load-carrying roller bearing adapter and the base of the pedestal jaw and being responsive to shear forces to yieldingly oppose relative departure of the axles from the central position throughout the range of relative angular positions of the wheelsets provided by said clearance.

* * * * *

UNITED STATES PATENT AND TRADEMARK OFFICE

CERTIFICATE OF CORRECTION

PATENT NO. : 4,938,152

DATED : July 3, 1990

INVENTOR(S) : Harold A. List

It is certified that error appears in the above-identified patent and that said Letters Patent is hereby corrected as shown below:

Column 6, line 36, after "car" insert --center plate with the rim of the center plate bowl L which--

Column 8, line 18, after "lateral" insert --.--

Column 8, line 59, after "relation" insert --between the pads and the side frames and bearing--

Column 10, line 15, "¼" should be --½--

Signed and Sealed this

Thirty-first Day of December, 1991

*Attest:*

HARRY F. MANBECK, JR.

*Attesting Officer*

*Commissioner of Patents and Trademarks*